US012318007B2

(12) United States Patent
Sun

(10) Patent No.: US 12,318,007 B2
(45) Date of Patent: Jun. 3, 2025

(54) FOLDABLE SOFA

(71) Applicant: NINGBO YOUSUN IMP. AND EXP. CO., LTD, Ningbo (CN)

(72) Inventor: Jiqiang Sun, Ningbo (CN)

( * ) Notice: Subject to any disclaimer, the term of this patent is extended or adjusted under 35 U.S.C. 154(b) by 157 days.

(21) Appl. No.: 18/208,851

(22) Filed: Jun. 12, 2023

(65) Prior Publication Data

US 2024/0407557 A1 Dec. 12, 2024

(51) Int. Cl.
*A47C 17/04* (2006.01)

(52) U.S. Cl.
CPC ..... *A47C 17/045* (2013.01)

(58) Field of Classification Search
CPC ..... A47C 17/04; A47C 17/1756; A47C 17/16; A47C 17/045; A47C 17/24; A47C 17/30; A47C 17/32; A47C 17/23; A47C 17/207; A47C 17/1655; A47C 4/30; A47C 31/02
USPC ..... 5/16, 35, 36
See application file for complete search history.

(56) References Cited

U.S. PATENT DOCUMENTS 2,377,374 A * 6/1945 Roth ..... A47C 17/30 5/17
4,443,901 A * 4/1984 Zimmerman ..... A47C 17/24 5/28
6,026,525 A * 2/2000 Davis ..... A47D 15/001 5/655
7,134,727 B2 * 11/2006 Williams ..... A47C 17/04 297/411.3
11,246,423 B2 * 2/2022 Kulik ..... A47C 17/23

FOREIGN PATENT DOCUMENTS

CN 103799752 B 5/2014
CN 114794781 A 9/2022

* cited by examiner

*Primary Examiner* — Justin C Mikowski
*Assistant Examiner* — George Samuel Gines
(74) *Attorney, Agent, or Firm* — Hawaii Patent Services; Nathaniel K. Fedde; Kenton N. Fedde

(57) ABSTRACT

Disclosed in the present invention is a foldable sofa includes a first base block, where an upper side of the first base block serves as a first use face, a side face of one side of the first base block serves as a front face, a first backrest fence is arranged on the first use face, a first fence groove which faces the front face and matches a human body is provided in the first backrest fence, and the first fence groove and the first use face cooperate to enclose a sofa use portion. A second base block is arranged on a lower side of the first base block, a lower portion of the side, close to the front face, of the first base block is hinged to the second base block, and a second backrest fence is arranged on the first backrest fence.

6 Claims, 3 Drawing Sheets

FOLDABLE SOFA

TECHNICAL FIELD

The present invention relates to the technical field of furniture, and in particular to the technical field of foldable sofas.

BACKGROUND

Shafa is a loanword transliterated from sofa, an English word, which refers to a multi-seat chair provided with a cushion. As a backrest chair, sofa is provided with springs or thick foamed plastic, etc., and also provided with armrests on both sides, which is a kind of soft furniture. The origin of sofa can be traced back to ancient Egypt around 2000 BC, but the true soft-bag sofa appeared in the late 16th century to the early 17th century. For the sofa at that time, stuffing was mainly from natural elastic materials such as horse hair, bird feathers and plant fluff, and then was covered with velvet, embroidery and other fabrics to form a soft surface for human contact. For example, the Farthingle chair, which was popular with the public in Europe at that time, was one of the earliest sofa chairs. Reviewing the history of sofa development in China, the first one that comes into mind is "Jade Table" of Han Dynasty. The "Jade Table", a seat covered with a thick layer of fabric, described in the Miscellaneous Records of Xijing, a Chinese book about an ancient history, can be regarded as the ancestor of the Chinese sofa. With development and progress of the society, people's demands on the sofa are not limited to a piece of furniture which can only be used for rest, and people begin to develop different functions of the sofa.

Disclosed in the Chinese patent No. CN103799752B is a foldable sofa bed. The foldable sofa bed includes a bed frame, a cushion and a backrest, where the bed frame includes two armrest frames, and a front cross rod and a rear cross rod that connect the two armrest frames. Long sliding grooves, which are backward and are inclined downwards, are provided in middles of the armrest frames. Two hinges and two connecting rods are further included. The hinge includes a front sheet and a rear sheet, the front sheet is connected to the cushion, and the rear sheet is connected to the backrest. The front sheet is provided with a guide rod, and the guide rod is slidably arranged in the sliding groove. Two ends of the connecting rod are hinged to the armrest frame and the backrest respectively. In a bed state, the guide rod is located at an upper end of the sliding groove, the cushion is supported on the front cross rod in a horizontal state, and the backrest is supported on the rear cross rod in a horizontal state. In a sofa state, the guide rod slides to a lower end of the sliding groove, and the backrest is supported by the connecting rod in an inclined state. Disclosed in the Chinese patent with the publication No. CN114794781A is a sofa bed. The sofa bed includes a seat portion, a backrest portion, a seat portion connecting rod, a backrest portion connecting rod, and two armrest frames. The seat portion connecting rod and the backrest portion connecting rod are connected in a manner of pivoting with each other and being locked with each other by means of a locking mechanism, and the locking mechanism is provided with a pin. The two armrest frames are arranged at two ends in a lengthwise direction of the seat portion and the backrest portion, each armrest frame is provided with a sliding groove which is open towards the backrest portion and the seat portion and partially extends in a transverse direction, and a rear end of the sliding groove is lower than a front end of the sliding groove.

The sofa bed with such a structure has the problems as follows: the whole sofa bed is supported by a bed frame, such that a strength requirement on the bed frame is high. Moreover, spacing between supporting legs of the bed frame is fixed, and when the sofa bed is unfolded to be used as a bed, an unfolding width of the sofa bed is far greater than the spacing between the supporting legs at two sides, resulting in poor stability of the sofa bed, the sofa bed is likely to roll over, and the safety is not high.

SUMMARY

An objective of the present invention is to provide a foldable sofa, which has three use states, and can be used as a sofa as well as a bed and a deck chair to satisfy various use demands, thereby solving the problems in the prior art.

In order to achieve the above objective, the present invention provides a foldable sofa. The foldable sofa includes a first base block, where an upper side of the first base block serves as a first use face, and a side face of one side of the first base block serves as a front face. A first backrest fence is arranged on the first use face, a first fence groove which faces the front face and matches a human body is provided in the first backrest fence, and the first fence groove and the first use face cooperate to enclose a sofa use portion. A second base block is arranged on a lower side of the first base block, a lower portion of the side, close to the front face, of the first base block is hinged to the second base block, and a second use face corresponding to the first use face is arranged on the second base block. When the second base block is turned over to be flushed with the first base block, the second use face is relatively flushed with the first use face, A second backrest fence is arranged on the first backrest fence, an upper portion of the side, close to the front face, of the first backrest fence is hinged to the second backrest fence, and the second backrest fence is provided with a second fence groove corresponding to the first fence groove.

Preferably, several first locking fasteners for keeping the second base block locked on the lower side of the first base block are arranged between the first base block and the second base block.

Preferably, several second locking fasteners for keeping the second backrest fence locked on an upper side of the first backrest fence are arranged between the first backrest fence and the second backrest fence.

Preferably, the first backrest fence and the second backrest fence are equal in size, and the first base block and the second base block are equal in size.

Preferably, outer walls of the first backrest fence, the second backrest fence, the first base block and the second base block each are wrapped with a fabric layer, where the first backrest fence is hinged to the fabric wrapped outside the second backrest fence by means of the fabric wrapped outside the first backrest fence, and the first base block is hinged to the fabric wrapped outside the second base block by means of the fabric wrapped outside the first base block.

Preferably, two ends of the front face of the first base block are connected to the second base block, and a separation seam is provided between connection positions of the two ends.

The foldable sofa of the present invention has the beneficial effects that: in the present invention, the foldable sofa has three use states, when the second base block, the first base block, the first backrest fence and the second backrest fence are in a sequential stacked state, the foldable sofa can be directly used as a sofa, and a user can directly sit on the sofa use portion formed by means of the first backrest fence, the second backrest fence and the first base block in an enclosed manner to have a rest. When the second base block is turned around a hinged position to the same plane as the first base block and the first use face is flush with the second use face, the second use state of this example is achieved. In the second use state, a person can directly lie on the first use face and the second use face, lean against the first backrest fence and the second backrest fence, and relax lower limbs. The present application can also be used as a bed, during use, the second base block is turned around the hinged position to be on the same plane as the first base block, and the first use face is flush with the second use face. Then the second backrest fence is turned to the upper side of the second use face, and the first use face and the second use face are used as a bed faces. The first backrest fence and the second backrest fence cooperate with each other to enclose a rectangular frame body which is used as a bedside guardrail, such that the safety is improved, and falling in a turning process is avoided. The foldable sofa provided by the present invention has three use manners, has multiple functions, is rich in functionality, can satisfy various use demands, and is low in cost, strong in function and small in occupied space. The present invention is simple in structure, is formed by combining four independent blocks, does not need a frame support, is high in stability and is less likely to roll over.

The features and advantages of the present invention will be described in detail in combination with the examples and accompanying drawings.

Figure 1:
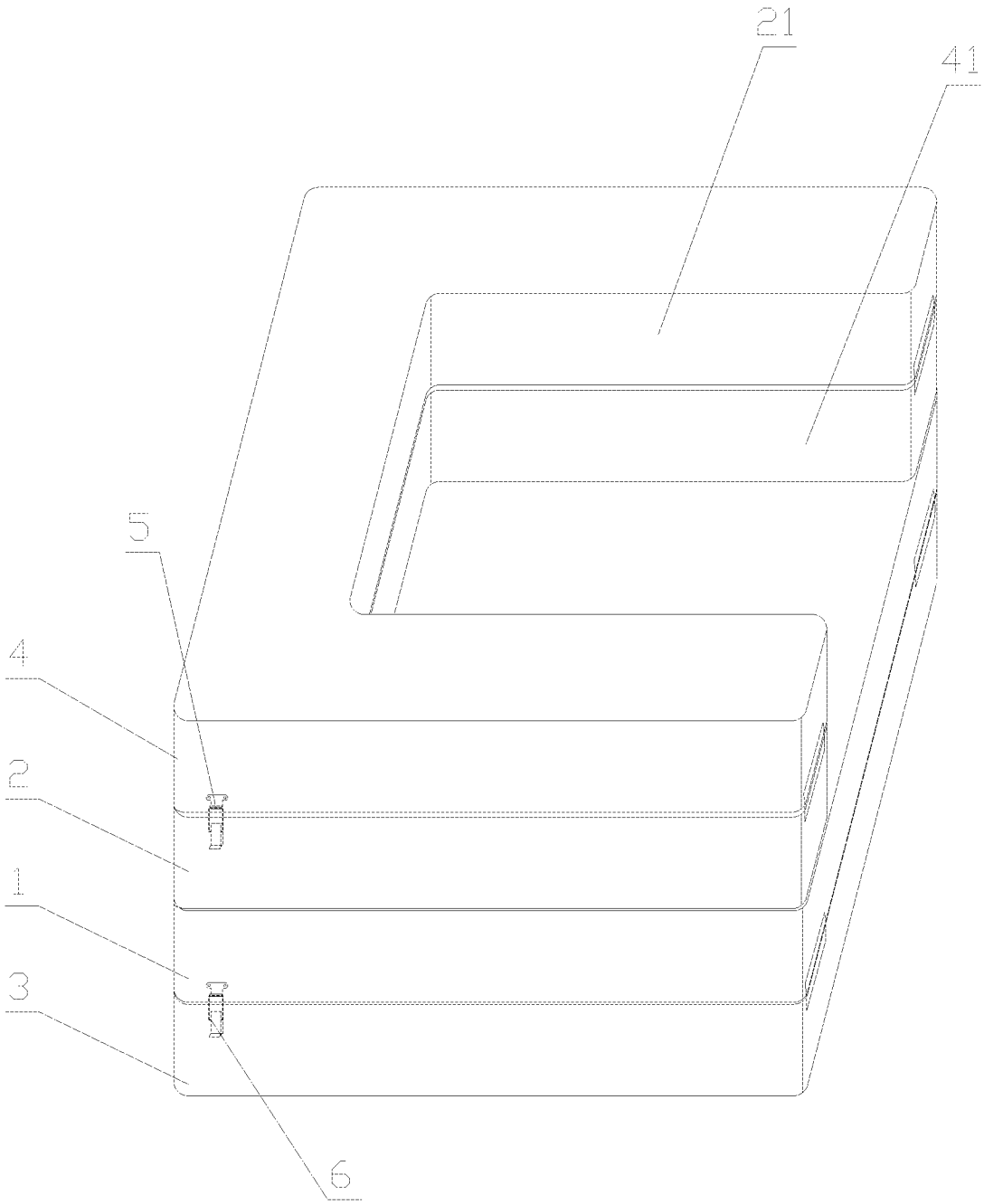
FIG. 1 is a schematic structural diagram of a foldable sofa of the present invention in a first use state.
Figure 2:
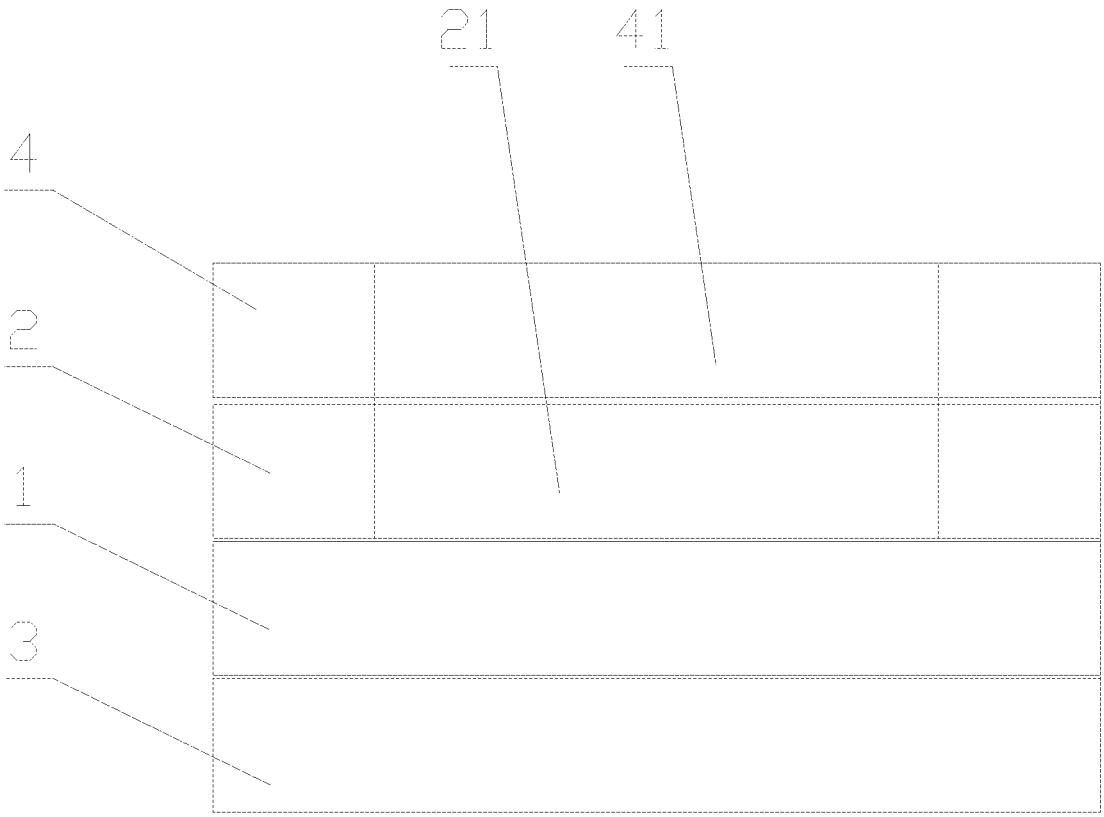
FIG. 2 is a schematic structural diagram from a front view of a foldable sofa of the present invention in a first use state.
Figure 3:
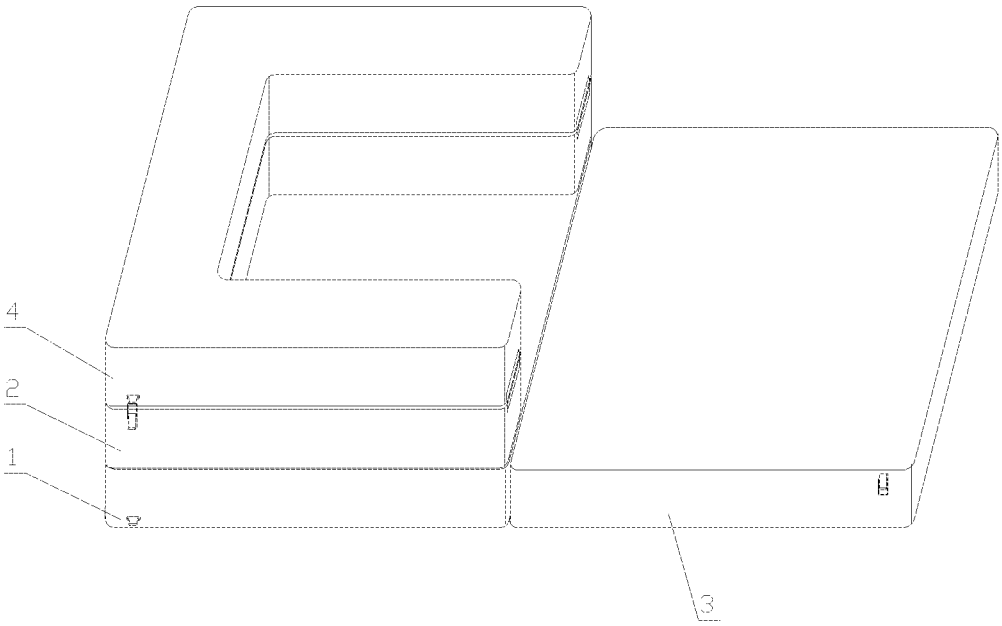
FIG. 3 is a schematic structural diagram of a foldable sofa of the present invention in a second use state.
Figure 4:
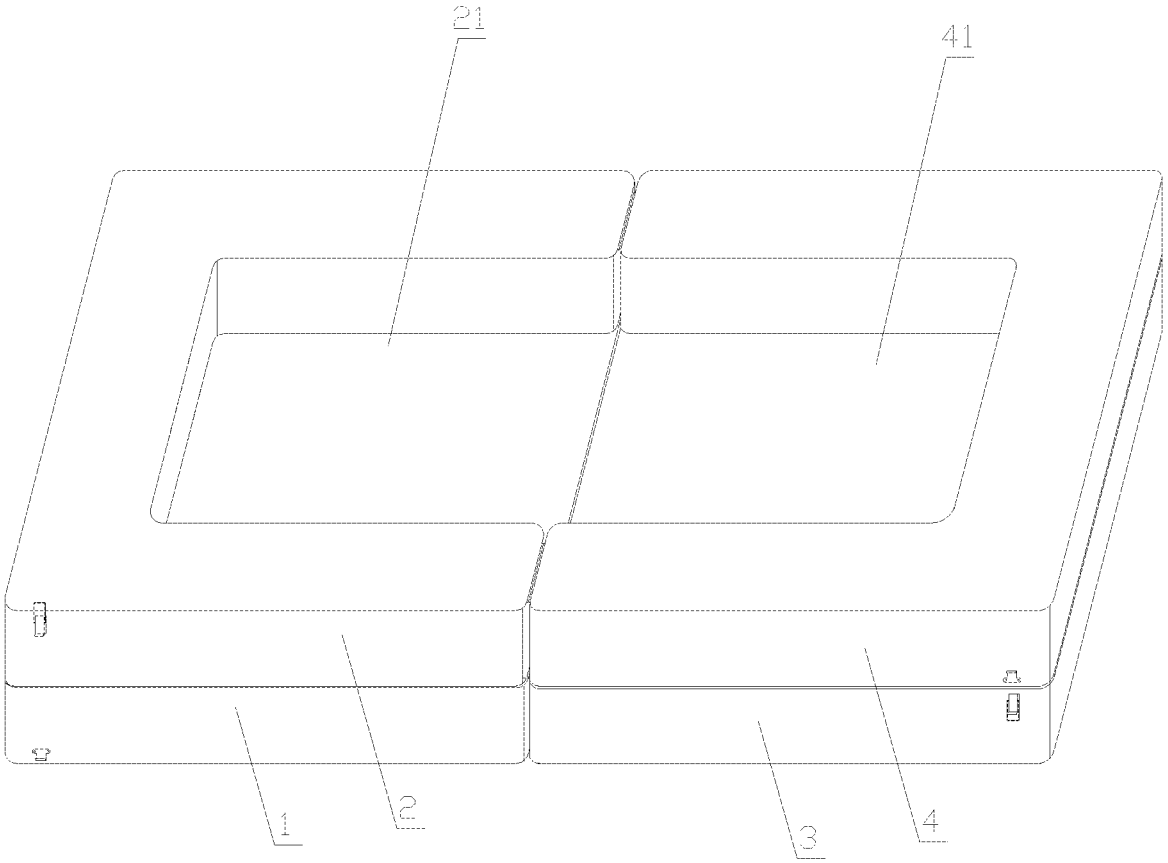
FIG. 4 is a schematic structural diagram of a foldable sofa of the present invention in a third use state.

In the figures: 1—first base block, 2—first backrest fence, 3—second base block, 4—second backrest fence, 5—first locking fastener, 6—second locking fastener, 21—first fence groove, and 41—second fence groove.

DETAILED DESCRIPTION

For making the objectives, technical solutions and advantages of the present invention clearer, the present invention will be further described in detail below in conjunction with the accompanying drawings and examples. It should be understood that the particular examples described herein are merely illustrative of the present invention and are not intended to limit the scope of the present invention. In addition, in the following specification, the description of the known structure and technique is omitted to avoid unnecessary confusion of the concept of the present invention.

It should be noted that when an element is referred to as being "fixed to" or "arranged on" another element, the element may be directly on another element or indirectly on the another element. When an element is referred to be "connected" to another element, the element may be directly or indirectly connected to another element.

In the description of the present invention, it should be noted that the terms "central", "length", "width", "thickness", "upper", "lower", "front", "back", "left", "right", "vertical", "horizontal", "top", "bottom", "inner", "outer", etc. indicate azimuthal or positional relations based on those shown in the accompanying drawings or the customary azimuthal or positional relations during use of the invention product, and are merely for facilitating description of the present invention and for simplifying description, rather than indicating or implying that the referenced device or element must have a particular orientation and be constructed and operative in a particular orientation, and thus may not be construed as a limitation on the present invention. In addition, the terms "first", "second", "third", etc. are merely for distinguish between descriptions and may not be understood as indication or implication of relative importance. Thus, a feature defined with "first" and "second" may explicitly or implicitly include one or more of the features. In the description of the present invention, "plurality" means two or more, unless expressly specified otherwise. "Several" means two or more, unless expressly specified otherwise.

In the description of the present invention, it should be noted that, unless otherwise explicitly specified and defined, the terms "arrangement" "mounting", "connecting" and "connection" should be understood in a broad sense, for example, they may be a fixed connection, a detachable connection, or an integrated connection; may be a mechanical connection, or an electrical connection; and may be a direct connection, or an indirect connection via an intermediate medium, or communication inside two elements. For those of ordinary skill in the art, the specific meanings of the above terms in the present invention may be understood according to specific circumstances.

Example 1

With reference to FIGS. 1-4, a foldable sofa of the present invention includes a first base block 1, a second base block 3, a first backrest fence 2, and a second backrest fence 4, where an upper side of the first base block 1 serves as a first use face, and a side face of one side of the first base block 1 serves as a front face. The first backrest fence 2 is arranged on the first use face, a first fence groove 21 which faces the front face and matches a human body is provided in the first backrest fence 2, and the first fence groove 21 and the first use face cooperate to enclose a sofa use portion. The second base block 3 is arranged on a lower side of the first base block 1, a lower portion of the side, close to the front face, of the first base block 1 is hinged to the second base block 3, and a second use face corresponding to the first use face is arranged on the second base block 3. When the second base block 3 is turned to be flushed with the first base block 1, the second use face is relatively flushed with the first use face. The second backrest fence 4 is arranged on the first backrest fence 2, an upper portion of the side, close to the front face, of the first backrest fence 2 is hinged to the second backrest fence 4, and the second backrest fence 4 is provided with a second fence groove 41 corresponding to the first fence groove 21. The foldable sofa in this example has three use states, when the second base block 3, the first base block 1, the first backrest fence 2 and the second backrest fence 4 are in a sequential stacked state, the foldable sofa can be directly used as a sofa, and a user can directly sit on the sofa use portion formed by means of the first backrest fence 2, the second backrest fence 4 and the first base block 1 in an enclosed manner to have a rest. When the second base block 3 is turned around a hinged position to the same plane as the first base block 1 and the first use face is flush with the second use face, the second use state of this example is achieved. In the second use state, a person can directly lie on the first use face and the second use face, lean against the first backrest fence 2 and the second backrest fence 4, and relax lower limbs. The present application can also be used as a bed, during use, the second base block 3 is turned around the hinged position to be on the same plane as the first base block 1, and the first use face is flush with the second use face. Then the second backrest fence 4 is turned to the upper side of the second use face, and the first use face and the second use face are used as a bed faces. The first backrest fence 2 and the second backrest fence 4 cooperate with each other to enclose a rectangular frame body which is used as a bedside guardrail, such that the safety is improved, and falling in a turning process is avoided. The foldable sofa of this example has three use manners, has multiple functions, is rich in functionality, can satisfy various use demands, and is low in cost, strong in function and small in occupied space.

With reference to FIG. 1, several first locking fasteners 5 for keeping the second base block 3 locked on the lower side of the first base block 1 are arranged between the first base block 1 and the second base block 3. When the first base block 1 is stacked on the upper side of the second base block 3, the first base block 1 and the second base block 3 are locked with each other by means of the first locking fasteners 5, thereby improving the stability and avoiding the first base block 1 from separating from the second base block 3.

With reference to FIG. 1, several second locking fasteners 6 for keeping the second backrest fence 4 locked on an upper side of the first backrest fence 2 are arranged between the first backrest fence 2 and the second backrest fence 4.

Preferably, the first backrest fence 2 and the second backrest fence 4 are equal in size, and the first base block 1 and the second base block 3 are equal in size. The first base block 1 and the second base block 3 have the same thickness, such that when the first base block 1 and the second base block 3 are spread out to be used as a bed body, the two base blocks can be kept at the same height, the comfort is improved, production is more convenient, and it is unnecessary to produce a plurality of parts with different sizes.

Preferably, outer walls of the first backrest fence 2, the second backrest fence 4, the first base block 1 and the second base block 3 each are wrapped with a fabric layer, where the first backrest fence 2 is hinged to the fabric wrapped outside the second backrest fence 4 by means of the fabric wrapped outside the first backrest fence, and the first base block 1 is hinged to the fabric wrapped outside the second base block 3 by means of the fabric wrapped outside the first base block Preferably, two ends of the front face of the first base block 1 are connected to the second base block 3, and a separation seam is provided between a connection position of the two ends. The first base block 1 and the second base block 3 at the position of the separation seam are not fixedly connected, and the first base block 1 only needs to be fixedly connected to the second base block 3 by means of the positions of the two ends of the front face, such that the connection positions are reduced as much as possible on the premise of ensuring stable connection, and a production process is more concise and efficient.

A working process of the present invention is as follows:

The foldable sofa of the present invention has three use states, when the second base block 3, the first base block 1, the first backrest fence 2 and the second backrest fence 4 are in a sequential stacked state, the foldable sofa can be directly used as a sofa, and a user can directly sit on the sofa use portion formed by means of the first backrest fence 2, the second backrest fence 4 and the first base block 1 in an enclosed manner to have a rest. When the second base block 3 is turned around a hinged position to the same plane as the first base block 1 and the first use face is flush with the second use face, the second use state of the present invention is achieved. In the second use state, a person can directly lie on the first use face and the second use face, lean against the first backrest fence 2 and the second backrest fence 4, and relax lower limbs. The present application can also be used as a bed, during use, the second base block 3 is turned around the hinged position to be on the same plane as the first base block 1, and the first use face is flush with the second use face. Then the second backrest fence 4 is turned to the upper side of the second use face, and the first use face and the second use face are used as a bed faces. The first backrest fence 2 and the second backrest fence 4 cooperate with each other to enclose a rectangular frame body which is used as a bedside guardrail, such that the safety is improved, and falling in a turning process is avoided.

The standard parts used in the present application document can be purchased from the market, the specific connection manners of various parts employ conventional means such as bolts, rivets, and welding that are mature in the prior art. Internal parts of an electric slide rail sliding seat, an air cylinder, a welding machine, an electric telescopic rod and a controller all employ conventional models in the prior art, and the internal structures thereof belong to the structures of the prior art, such that workers can complete normal operation according to the manual of the prior art. In addition, a circuit connection employs the conventional connection manner in the prior art, which is not described in detail here.

It should be noted that although the examples mentioned above have been described herein, they do not therefore limit the patent protection scope of the present invention. Therefore, based on the innovative ideas of the present invention, variations and modifications made on the examples of the description, or equivalent structure or equivalent process change made by using contents of the description and the accompanying drawings in the present invention and used directly or indirectly in other related technical fields shall all fall within the protection scope of the present invention.

What is claimed is:

1. A foldable sofa, comprising a first base block, wherein an upper side of the first base block serves as a first use face, a side face of one side of the first base block serves as a front face, a first backrest fence is arranged on the first use face, a first fence groove which faces the front face, and is configured to fit a body of a user, is provided in the first backrest fence, and the first fence groove and the first use face cooperate to enclose a sofa use portion; and a second base block is arranged on a lower side of the first base block, a lower portion of the lower side, closest to the front face, of the first base block is hinged to the second base block, a second use face corresponding to the first use face is arranged on the second base block, when the second base block is turned to be flush with the first base block, the second use face is flush with the first use face, a second backrest fence is arranged on the first backrest fence, an upper portion of a side, closest to the front face, of the first backrest fence is hinged to the second backrest fence, and the second backrest fence is provided with a second fence groove corresponding to the first fence groove.

2. The foldable sofa according to claim 1, wherein a plurality of first locking fasteners for keeping the second base block locked on the lower side of the first base block are arranged between the first base block and the second base block.

3. The foldable sofa according to claim 1, wherein several second locking fasteners for keeping the second backrest fence locked on an upper side of the first backrest fence are arranged between the first backrest fence and the second backrest fence.

4. The foldable sofa according to claim 1, wherein the first backrest fence and the second backrest fence are equal in size, and the first base block and the second base block are equal in size.

5. The foldable sofa according to claim 1, wherein outer walls of the first backrest fence, the second backrest fence, the first base block and the second base block each are wrapped with a fabric layer, the first backrest fence is hinged to the fabric layer wrapped outside the second backrest fence by means of the fabric layer wrapped outside the first backrest fence, and the first base block is hinged to the fabric layer wrapped outside the second base block by means of the fabric layer wrapped outside the first base block.

6. The foldable sofa according to claim 5, wherein two ends of the front face of the first base block are connected to the second base block, and a separation seam is provided between a connection position of the two ends.

* * * * *